United States Patent [19]

Uroshevich

[11] 4,016,887

[45] Apr. 12, 1977

[54] TWO-STAGE TOBACCO SMOKE FILTER

[76] Inventor: Miroslav Uroshevich, 2505 Fleetwood Ave., Cincinnati, Ohio 45211

[22] Filed: June 21, 1973

[21] Appl. No.: 372,182

[52] U.S. Cl. ..... 131/261 R; 131/10.5

[51] Int. Cl.[2] ..... A24D 1/06

[58] Field of Search ..... 131/9, 10 R, 10.3, 10.5, 131/10.7, 10.9, 210, 216, 261 R, 262 A

[56] References Cited

UNITED STATES PATENTS

| | | | |
|---|---|---|---|
| 925,381 | 6/1909 | Regenold | 131/210 |
| 2,815,760 | 12/1957 | Schreus et al. | 131/262 A |
| 3,318,312 | 5/1967 | Curtis, Jr. | 131/10.5 |
| 3,604,428 | 9/1971 | Moukaddem | 131/10.5 |

FOREIGN PATENTS OR APPLICATIONS

| | | | |
|---|---|---|---|
| 6,901,332 | 7/1970 | Netherlands | 131/10.5 |

*Primary Examiner*—Robert W. Michell
*Assistant Examiner*—Vincent Millin
*Attorney, Agent, or Firm*—Irwin P. Garfinkle; Gary M. Gron

[57] ABSTRACT

A tobacco smoke filter for use with a cigarette comprising a tube having a conical disc at its upstream end adjacent the tobacco. A capillary orifice through the apex of the conical disc permits discharge of tobacco smoke from the cigarette at high velocity into a downstream chamber for sublimation of alkaloids and other harmful matter to solid particles by rapid expansion. A parabolic disc is positioned in line with the high velocity jet to trap the solid particles and reverse flow to promote turbulence. The disc has a periphery closely adjacent the inner wall of the tube to promote a high speed flow around its edge. The resulting turbulence causes additional deposition of solids on the disc's downstream face. A tube integral with the disc extends to a circular opening in the downstream end of the tube for discharge of filtered smoke. Certain surfaces in the filter, such as the upstream side of the disc, may be coated with a catalyst to enhance a beneficial chemical reaction of constituents in the tobacco smoke.

5 Claims, 2 Drawing Figures

TWO-STAGE TOBACCO SMOKE FILTER

The present invention relates to filters and more particularly to filters for tobacco smoke. In recent years there have been many attempts to make the filtering of certain impurities in tobacco smoke more effective. Some of these filters use a foraminus filter material through which the tobacco smoke must pass and others use flow-modifying devices. Some filters pass the tobacco smoke through capillary orifices to accelerate it to a high velocity and to discharge it at a wall or other surface in the filter to collect particulate matter. Examples of this type of approach may be found in the U.S. Pat. to Siragusa, No. 3,457,927, Lebert, No. 2,954,778, and Curtis, Jr., No. 3,269,394. In each of these patents tobacco smoke is directed through a capillary orifice for discharge at high velocity against a surface or a downstream filter.

While these are generally effective at removing some of the impurities of the tobacco smoke, they do not do as complete a job. This necessitates the use of secondary filtering elements which add to the complexity and size of the filter.

The present invention solves the above problems by providing a filter for tobacco smoke which comprises a tubular element in which tobacco smoke is directed at high velocity into an expansion chamber against a disc which has a periphery closely adjacent to the interior walls of the tubular element. This causes tobacco smoke to flow at high velocity around its periphery, thereby generating turbulence on its downstream face and resultant depositing of particulate matter in the tobacco smoke. The filtered tobacco smoke passes from the filter through openings adjacent the downstream face of the disc.

The above and related features of the present invention will be apparent from a reading of the following description of the disclosure shown in the accompanying drawing and the novelty thereof pointed out in the appended claims.

Figure 1:
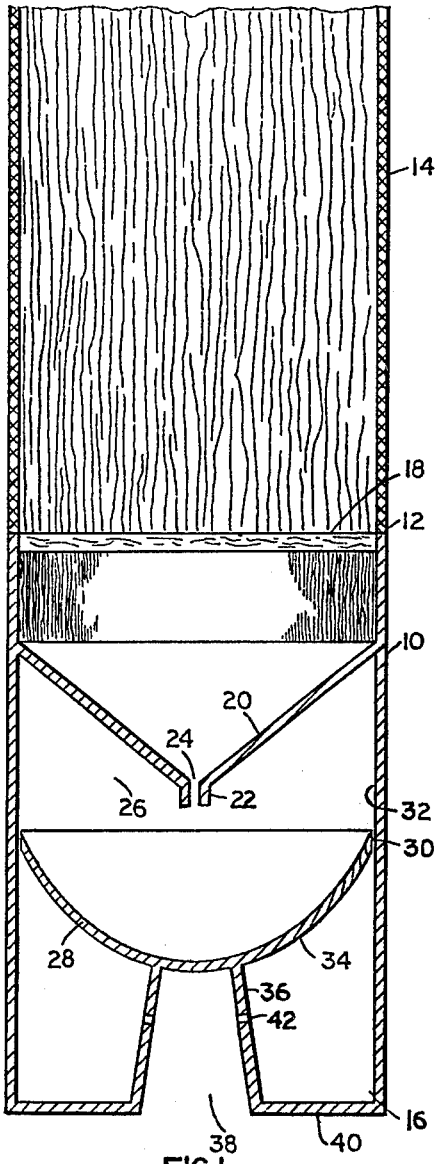
FIG. 1 shows a longitudinal section view of a tobacco smoke filtering device embodying the present invention.

Referring to FIG. 1, the filter apparatus comprises a tubular exterior case 10 having an upstream end 12 connected to tobacco-containing device 14, such as a cigarette, and a downstream end 16 for discharge of the tobacco smoke. The filter to be described may be used with many types of tobacco-containing devices, such as cigars or pipes, with equal success. It should be apparent to those skilled in the art that the tubular element would be fastened to the tobacco-containing device 14 in suitable fashion. A filtering element 18 is positioned across the first end 12 of the tubular element 10. Filter element 18 stops tobacco from clogging the filter apparatus. The filter element 18 may also include an activated charcoal or similar chemical filter. A conical disc 20 is positioned in the first end 12 of the tubular element 10 and has an apex 22 pointed in a downstream direction through which a capillary orifice 24 is formed. Capillary orifice 24 connects with an expansion chamber 26 defined in part by the downstream side of the conical disc 20 and the periphery of the tubular element 10. A disc 28 is positioned downstream of the chamber 26 and has a generally circular periphery closely adjacent to the interior wall 32 of the tubular element 10 to form an annular passage having a relatively small flow area. Preferably, the disc 28 has a parabolic cross section, particularly shown in FIG. 1, although other concave configurations may be used. The downstream face 34 of disc 28 is supported by an integral tube 36 extending to an opening 38 in a circular disc 40 positioned across the downstream end 16 of the tubular element 10. It should be noted that disc 28 may alternately be supported by the inner walls of tube 10 through suitable connections. Tube 36 has side openings 42 which connect the downstream side 34 of the deflector to the interior of the tube 36 and thus to the exterior of the tubular element 10.

In operation, tobacco smoke is drawn through the tubular element 10. The tobacco smoke is first physically filtered by the filter element 18 and/or chemically filtered by the charcoal (activated) or similar chemical filter. The smoke is then accelerated to a high velocity by the upstream face of the conical disc 20. The capillary orifice 24 causes the tobacco smoke to be discharged at high velocity into the expansion chamber 26, thus causing a sublimation of the alkaloids to solid particles by rapid expansion. The solid particles then collect on the upstream face of disc 28. The tobacco smoke, however, is redirected and deflected by the upstream face of disc 28 to promote substantial turbulence. The upstream face of disc 28 defines a parabola having a focus at the capillary orifice 24. The smoke discharged from orifice 24 diverges and as it strikes the surface of disc 28 is deflected in parallel streams toward an upstream direction. This causes additional deposition of particles on the downstream face of conical disc 20.

Figure 2:
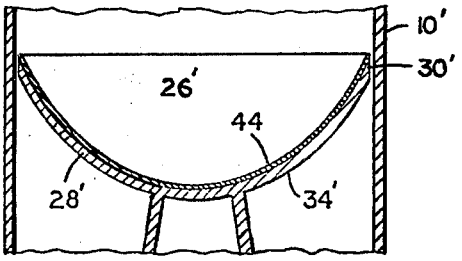
FIG. 2 shows a fragmentary longitudinal section view of a tobacco smoke filtering device illustrating an alternate embodiment of the present invention.

The smoke then flows around the periphery 30 of the disc 28 where it is again accelerated to a high velocity. The high velocity flow around the periphery of the disc 28 causes a substantial turbulence to be built up along its downstream face 34. This in turn causes particulate matter within the tobacco smoke to be deposited on the back face of the disc 28. The tobacco smoke that has been effectively filtered passes inward through openings 42 to the interior of tube 36 and then to the smoker. Certain surfaces within the filter may be coated with a catalyst, such as platinum, to enhance a beneficial chemical reaction of certain of the tobacco smoke constituents. As shown in FIG. 2, a catalyst 44 may be coated on the upstream face of disc 28.

The filter described above is highly effective and efficient in complete filtering of harmful impurities from the tobacco smoke while retaining essential flavors. The simplicity of the parts makes the filter extremely economical to manufacture. The design of the filter permits the flow modification to take place in a relatively short axial distance, thereby minimizing the length necessary to provide an adequate filtering device.

While the preferred embodiment of the present invention has been described, it should be apparent to those skilled in the art that it may be practiced in other forms without departing from its spirit and scope.

Having thus described the invention, what is claimed as novel and desired to be secured by Letters Patent of the United States is:

1. Apparatus for filtering tobacco smoke, comprising:

a generally tubular element connectable at an upstream end to a tobacco-containing body and defining a generally cylindrical chamber through which tobacco smoke is drawn toward a downstream end of said element;

funnel means adjacent the upstream end of said tubular element, said funnel means terminating downstream in an apex forming an axial capillary orifice for accelerating smoke in a high velocity stream toward the downstream end of said tubular element, said funnel means forming in cooperation with the interior wall of said tubular element an expansion chamber into which said stream is discharged whereby said smoke is decelerated in said expansion chamber;

a parabolic disc for collecting particulate material, said parabolic disc being positioned downstream of said orifice, the axis of said parabolic disc being in the path of smoke discharged from said orifice, said parabolic disc having a periphery closely spaced from the interior walls of said tubular element, whereby said smoke is again accelerated to flow at high velocity around said periphery, thereby inducing turbulence adjacent the downstream side of said parabolic disc and causing the deposition of particulate material thereon;

means downstream of said parabolic disc for defining an additional expansion chamber and a flow path to the exterior of said tubular element, said means comprising a transverse circular end disc positioned in the downstream end of said tubular element and having a central opening therein, and a tube extending from said central opening to the downstream face of said parabolic disc, said additional chamber being defined by the said circular disc, said parabolic disc, said tubular element and said tube, said tube having side openings defining a flow path from the said additional expansion chamber to the interior of said tube.

2. Apparatus as in claim 1 wherein said tube and parabolic disc are integral, whereby said parabolic disc is supported by said tube.

3. Apparatus as in claim 2 further comprising a filter element positioned across the upstream end of said tubular element.

4. Apparatus as in claim 3 wherein one of the interior surfaces of said filter is coated with a catalyst.

5. Apparatus as in claim 4 wherein the upstream face of said parabolic disc is coated with said catalyst.

* * * * *